US008668089B2

(12) United States Patent
Feldmann et al.

(10) Patent No.: US 8,668,089 B2
(45) Date of Patent: Mar. 11, 2014

(54) SYSTEM CRATE, IN PARTICULAR FOR TRANSPORTING FRESH FISH

(75) Inventors: André Feldmann, Hamburg (DE); Arne Schultchen, Hamburg (DE)

(73) Assignee: "Deutsche See" GmbH, Bremerhaven (DE)

( * ) Notice: Subject to any disclaimer, the term of this patent is extended or adjusted under 35 U.S.C. 154(b) by 594 days.

(21) Appl. No.: 12/302,318

(22) PCT Filed: May 25, 2007

(86) PCT No.: PCT/EP2007/004663
§ 371 (c)(1),
(2), (4) Date: Nov. 25, 2008

(87) PCT Pub. No.: WO2007/137774
PCT Pub. Date: Dec. 6, 2007

(65) Prior Publication Data

US 2010/0096288 A1 Apr. 22, 2010

(30) Foreign Application Priority Data

May 29, 2006 (DE) ..... 10 2006 025 198

(51) Int. Cl.
*B65D 21/04* (2006.01)

(52) U.S. Cl.
USPC ..... 206/505; 220/571; 206/507

(58) Field of Classification Search
USPC ..... 206/505, 507, 506, 509; 220/571, 220/DIG. 6, 23.6
See application file for complete search history.

(56) References Cited

U.S. PATENT DOCUMENTS 2,813,656 A * 11/1957 Anderson ..... 206/507
2,823,829 A * 2/1958 Frater ..... 206/507
3,052,373 A * 9/1962 Frater ..... 206/507

(Continued)

FOREIGN PATENT DOCUMENTS

DE 41 03 333 8/1992
DE 93 16 073 11/1994

(Continued)

OTHER PUBLICATIONS

International Preliminary Report on Patentability dated Feb. 17, 2009 and International Search Report dated Sep. 27, 2007 from the related PCT/EP2007/004663.

*Primary Examiner* — Andrew Perreault
(74) *Attorney, Agent, or Firm* — White & Case LLP

(57) ABSTRACT

The present invention relates to a crate (2) of a system of crates, in particular for transporting fresh fish, which has an opening (16) on the top side, and wherein the edge area as well as the base area of the opening on the top side are designed in such a manner that the base area on the edge of the opening on the top side is laterally and positively placed on an identical crate; thus the crates can be stacked on top of each other such that the upper crate can be inserted into the lower crate, rotated about a vertical axis by 180°, and thus the empty boxes can be stacked into one another (180° stack-nest crate), and said crate is thereby characterized in that the edge area (10) of the opening on the top side is designed, at least in terms of area, in a channel shape and has at least one first through hole (30) which is located on the outer side at the bottom of the crate wall adjacent to the edge area, and in that the base of the crate features a second through hole (30) so that liquid can drain out of the crate through the second through hole into the channel-shaped area of a similar crate stacked below, and then through the first through hole of the crate stacked below, out of the channel-shaped area alongside the outer side crate wall adjacent to the edge area of the lower side.

10 Claims, 6 Drawing Sheets

(56) References Cited

U.S. PATENT DOCUMENTS

Figure 1:
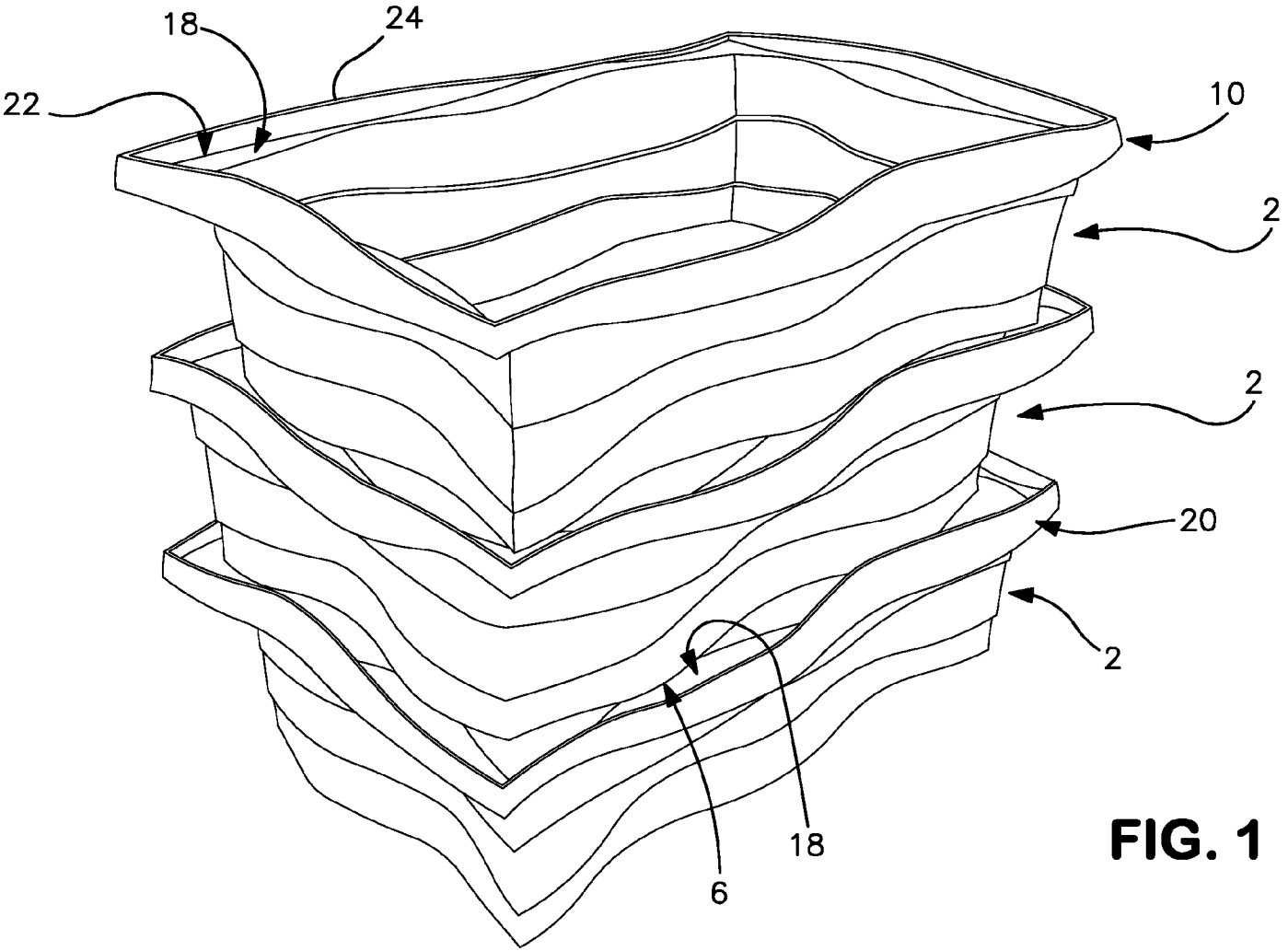

| | | | | | |
|---|---|---|---|---|---|
| 3,191,796 | A | | 6/1965 | Schwartz et al. | |
| 4,007,839 | A | * | 2/1977 | Stahl | 206/503 |
| 4,316,540 | A | * | 2/1982 | Lapham | 206/507 |
| 4,386,700 | A | * | 6/1983 | Deaton | 206/507 |
| 5,615,798 | A | * | 4/1997 | Luburic et al. | 220/572 |
| 5,860,527 | A | | 1/1999 | Frankenberg et al. | |
| 5,908,133 | A | * | 6/1999 | Luburic et al. | 220/572 |
| 7,204,056 | B2 | * | 4/2007 | Sieverding | 206/515 |

FOREIGN PATENT DOCUMENTS

| | | | |
|---|---|---|---|
| DE | 297 21 617 | | 2/1998 |
| EP | 0 680 886 | | 11/1995 |
| GB | 1292711 | * | 10/1972 |

* cited by examiner

SYSTEM CRATE, IN PARTICULAR FOR TRANSPORTING FRESH FISH

The present invention relates to a rotatable stacking crate belonging to a system of crates, in particular for transporting fresh fish, according to the preamble of claim 1.

It has long been known to transport goods using crates. Crates are usually defined as open-top containers which are provided laterally with carrying aids—for example, handle straps or handle-forming edges. As is well known, crates can be provided with lids.

To make it possible for the crates to be used not only for better transport of goods but also for their storage, there are stackable crates. These are, for example, designed in their base and in their upper edge region in such a way that the base of the upper crate engages positively in the upper edge region of the lower crate and is thus secured against sliding off laterally. A known further development is offered by so-called rotatable stacking crates. Their upper edge and lower base are designed in such a way that, on the one hand, the base of such a crate when placed on the edge of an identical crate is positively held laterally, and the crates can thus be stacked above one another, and such that, on the other hand, the upper crate can be inserted into the lower crate by being rotated through 180° about a vertical axis. In this latter position, the crates can be stacked inside one another in a space-saving manner in the empty state.

Fresh fish must be stored under cool conditions when transported for lengthy periods of time so as not to spoil. As is well known for this purpose, the fish is stored in crates or troughs together with ice. During the transport, melt water then forms, for example, which should flow away from the transport crate, ideally without wetting the fish more than is absolutely necessary. To this end, transport crates for such goods have outflow openings in the base region of the crate, thereby allowing liquid to flow from the crate.

Finally, stackable transport crates are known in which the outflow openings are arranged in an edge region of the base in such a way that the liquid flows therefrom into the upper edge region of the crate positioned underneath, where a drainage opening ensures that the liquid flows from there not into this crate but through the drainage opening and to the outside of the crate.

If, however, fresh fish requiring a lengthy period of transport is transported, for example, in relatively large amounts of ice in a crate, there result quite large amounts of melt water which should flow away from the crate. The drainage elements of known crate systems are to date not effective enough to cope with relatively large amounts of water flowing off and have the disadvantage that certain amounts of water are still not efficiently enough discharged to the outside along the crate walls but penetrate the interior of crates stacked underneath and disadvantageously wet the transported goods therein once more.

The object on which the present invention is based is to provide a crate belonging to a system of crates, in particular for transporting fresh fish, by means of which the water flowing from the crate is kept away more efficiently from the interior of a crate stacked underneath.

This object is achieved by a crate having the features of claim 1. Preferred embodiments are given in the subclaims.

According to the invention, a crate serves in particular for transporting fresh fish. The crate according to the invention is part of a system of crates made up of a plurality of identical crates which can be stacked on top of one another. Preferably, the crates forming the crate system have a plurality of sizes which can nevertheless be stacked on top of one another—for example by two identical smaller crates of the crate system (for example each having substantially half a horizontal area) being able to be stacked on a crate of the crate system having a full horizontal area.

The crate according to the invention is provided at its top with an opening through which the goods which are to be transported can be placed in the interior of the crate. In this respect, the crate is as it were trough-shaped. However, the crate according to the invention can also have a removable lid as an element. The top edge region of the crate according to the invention and the base region of said crate are designed in such a way that, on the one hand, the base region when placed on the top edge region of an identical crate is positively held laterally and the crates can thus be stacked above one another. On the other hand, the crate according to the invention can be inserted into a lower (non-rotated) crate by being rotated through 180° about a vertical axis, such that the crates can be stacked inside one another in a space-saving manner in the empty state (and, if present, without a lid). Crates using this basic principle are known as rotatable stacking crates.

According to the invention, the edge region of the top opening of the crate is of channel-shaped design at least in certain regions. For example, a channel there extends approximately in the manner of a roof gutter preferably in the corner region of the crate and preferably around the corner if the latter has a substantially rectangular basic shape, at least in plan view. Particular preference is given to a channel-shaped design of the edge region running around the entire top opening.

To allow water to flow from the channel, a first through bore is formed as an outflow in the channel such that the first through bore opens outside the crate wall which adjoins the underside of the channel-shaped edge region. Thus, liquid flows off through the first through bore from the channel on the outer side of the crate wall—and hence also on the outer side of the crate interior away from goods transported therein. Preferably, the base or bottom of the channel is designed as a slope in the direction of the first bore when the channel is positioned horizontally so as to ensure that the liquid can flow reliably from the channel. In particular, a channel preferably designed to have a long extent can comprise a plurality of first bores in order to ensure that the liquid flows off reliably from the channel at a plurality of points. Preferably, the slope in that case leads to the immediately adjacent first bore in each case. It is even possible, without having to be particularly preferred, for the channel to be interrupted, for example, by transverse walls which can serve to reinforce the crate edge mechanically, for example. In this case, each section of the channel divided by such a transverse wall preferably has its own first bore.

According to the invention, the base of the crate also has at least one through bore as an outflow for liquid. With the crate positioned horizontally, this second through bore is formed in the edge region of the base below the channel-shaped edge region. Thus, liquid can flow from the interior of the crate through the second bore into the channel-shaped edge region of a crate of the crate system that is stacked underneath. From there, the liquid flowing off can then, as described, flow through the first bore on the outer side of the crate wall. Preferably, the second through bore is arranged as close as possible to the base edge and, in the case of a crate having a substantially rectangular basic shape, in at least one of the four corners of the base. Preferably too, the base of the crate is inclined in each region with respect to a first bore to ensure the liquid flows off reliably.

These and other features of the invention will be described with reference to the appended figures which depict exemplary embodiments of the present invention.

Figure 2:
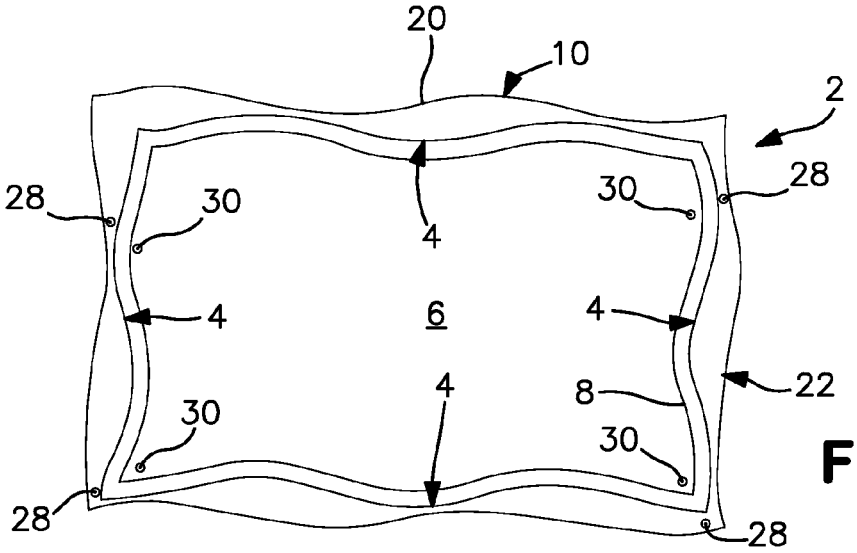
Figure 3:
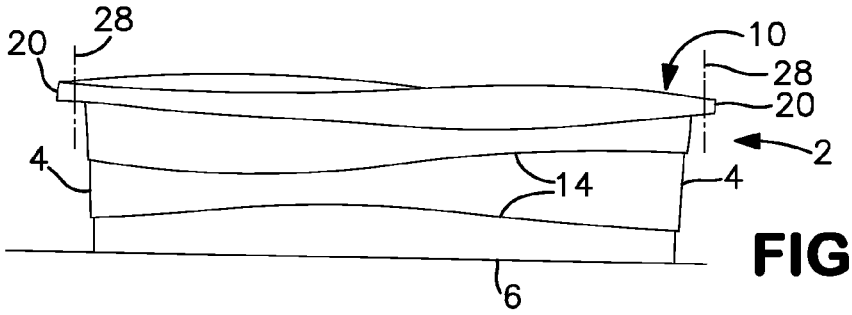
Figure 3A:
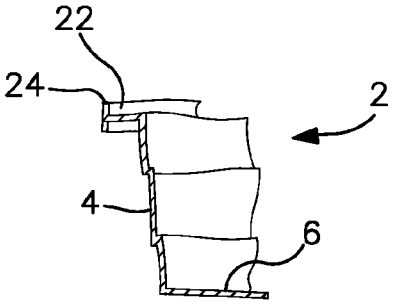
Figure 3B:
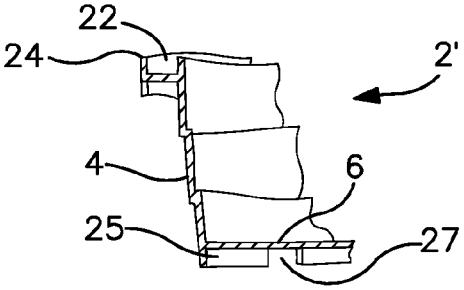
Figure 5:
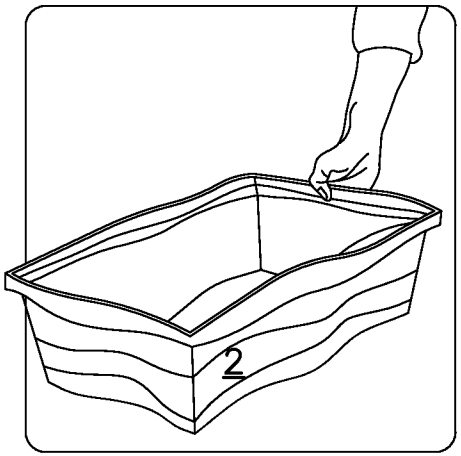
Figure 4:
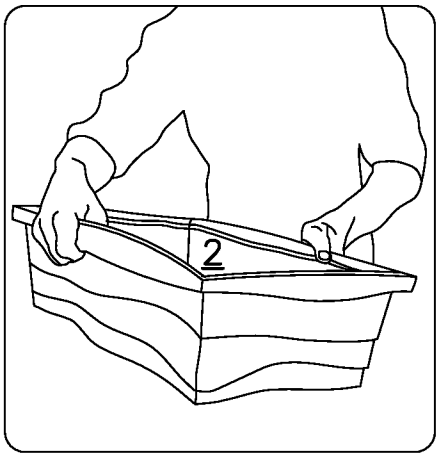
Figure 7:
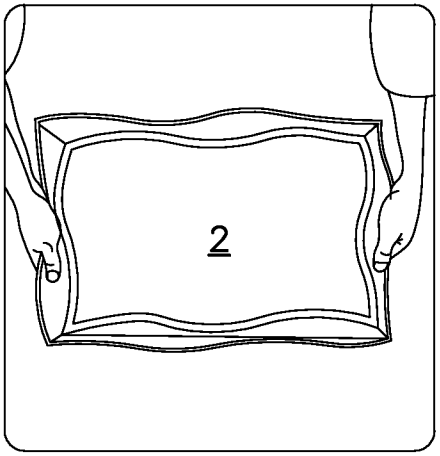
Figure 6:
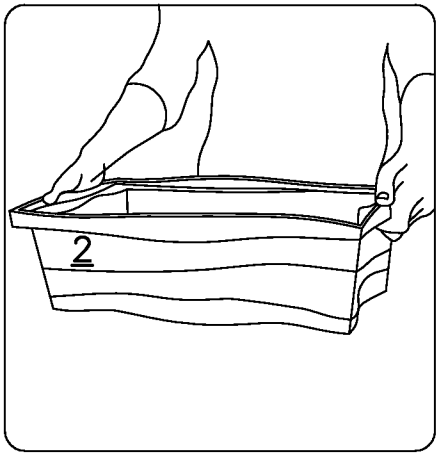
Figure 8:
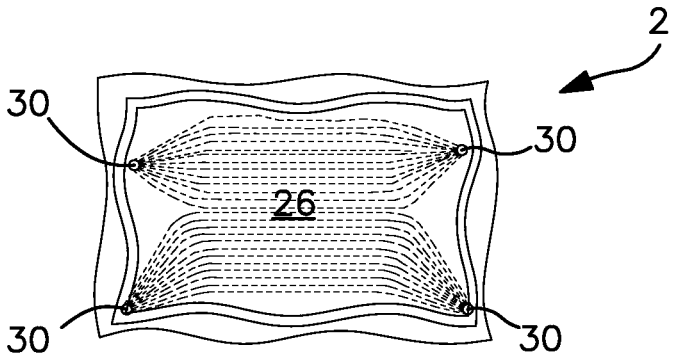
Figure 9:
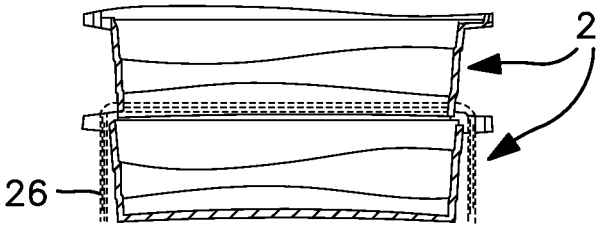
Figure 10:
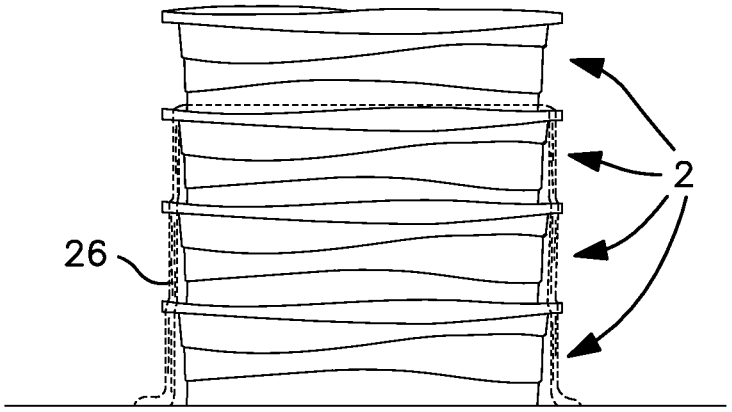
Figure 11:
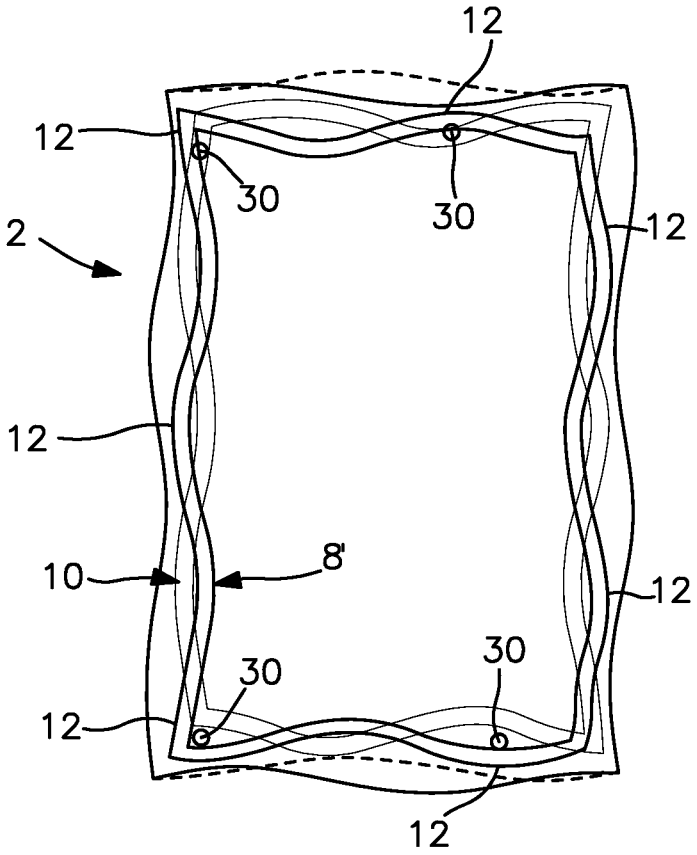
Figure 12:
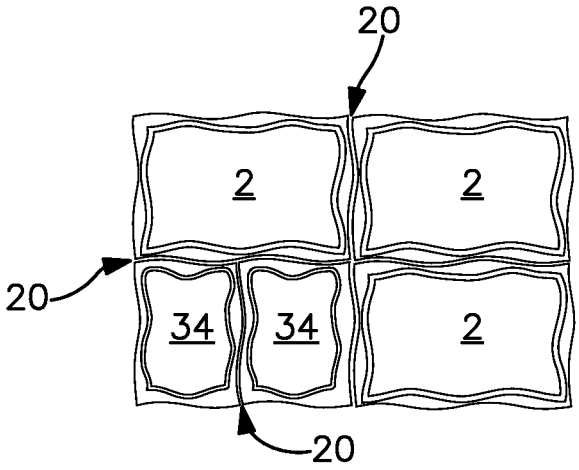
Figure 13:
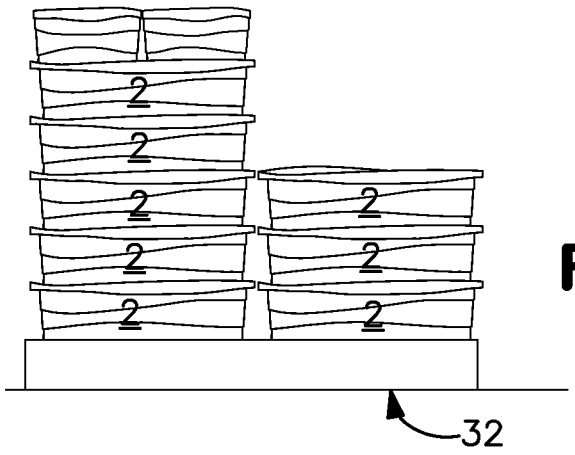

FIG. 1 shows a three-dimensional view of three crates according to the invention stacked on top of one another, FIG. 2 shows a plan view of a crate according to FIG. 1, FIG. 3 shows a side view of a crate according to FIG. 1, FIG. 3*a* shows a sectional side view of a crate according to FIG. 1, FIG. 3*b* shows a sectional side view of an alternative crate, FIGS. 4 to 7 show three-dimensional views of a crate according to FIG. 1 in the hands of a carrier, FIG. 8 shows a schematic plan view of the fluid flow paths from a crate according to FIG. 1, FIG. 9 shows a schematic side view of the flow paths from two crates according to FIG. 1 stacked above one another, FIG. 10 shows a schematic side view of the flow paths from four crates according to FIG. 1 stacked above one another, FIG. 11 shows a schematic plan view of two crates according to FIG. 1 stacked above one another, FIG. 12 shows a schematic plan view of five crates, in two different sizes, of the crate system placed laterally and positively against one another, and FIG. 13 shows a side view of FIG. 12 with a plurality of crates stacked next to one another and above one another on a transport pallet.

FIGS. 1 to 3 depict a trough-shaped transport crate 2 injection molded as a translucent molding from HDPE (high-density polyethylene) for transporting fresh fish. The crate 2 is trough-shaped without a lid and has a substantially rectangular basic shape—see the plan view according to FIG. 2.

FIGS. 1 to 3 clearly show the wavy shape, a much used design form for the crate 2. This is not only important for esthetic reasons, i.e. drawing an association with water—a medium in which proverbially a fish feels happy—, but also has a technical function in a number of respects. Thus, the crate walls 4 as seen in plan view (FIG. 2) are wavy and thus produce an overall pattern in which a second identical crate 2—identical to the crate 2 as aligned according to FIG. 2—can be stacked in a space-saving manner therein in the empty state, for example in order to stow unused crates. To achieve this possibility of inserting crates aligned thus inside one another in a space-saving manner, use is made of the feature whereby the crate walls 4 taper conically toward one another in the direction of the crate base 6 (see FIG. 3). On the other hand, using the principle of the rotatable stacking crate, the wavy pattern of the side walls 4 as seen in plan view (FIG. 2) allows a rotation through 180° such that the base edge 8' of an identical crate stacked on top is supported on the edge 10 of the crate (see FIG. 11) at points 12 distributed uniformly over the circumference of the crate edge 10—which points can be pre-embossed on the edge 10 and/or under the base edge 8' in order to positively connect the crates 2 stacked on top of one another. Therefore, by each of the crates 2 being rotated with respect to one another through 180° about a vertical axis, they can be stacked on top of one another (see FIGS. 1, 9, 10, 11 and 13).

FIG. 3 clearly shows stepped reliefs 14 in the crate wall 4. These stepped reliefs in turn extend in a wavy shape around the crate 2; this also has not only the esthetic effect mentioned but additionally reinforces the crate walls 4. The steps could also be designed in such a way as to prevent a situation in which the crates adhere when stacked inside one another and can only be unstacked with difficulty.

With reference to FIG. 1, the edge region 10 of the top opening 16 of the crate 2 is in the shape of a T lying horizontally. In other words, the vertical section through the crate 2 in the upper edge region 10 is designed in such a way as to present the shape of a capital letter T which is tilted outwardly from the crate through 90°. The actual vertical arm of the T then consequently forms a substantially horizontal oriented edge surface 18—inclined slightly outwardly so as to form a channel wall overall—, on which edge surface the base 6 of a crate 2 stacked thereon comes to bear with its base edge region (FIG. 1). Furthermore, the actual horizontal bar of the T, as a result of being tilted outwardly from the crate through 90°, forms an edge surface 20—in turn having a wavy shape—extending wholly around the outer side.

This edge surface 20 produces a handle-forming edge by way of its region which extends downwardly from the surface 18, said handle-forming edge extending right round the crate 2. The crate 2 according to FIGS. 4 to 7 can, for example, be gripped, pulled or carried using this edge. The upwardly extending region of the outer edge surface 20, together with the surface 18 (which, as already mentioned, is formed with an outward incline right around the crate 2), forms a channel 22 around the entire top opening 16.

The upper edge 24 of the lateral edge surface is also wavy in turn.

Alternatively, instead of the T-shaped edge cross section tilted outwardly through 90° (FIG. 3*a*), the edge can also be formed with an H-shaped cross section (FIG. 3*b*). In that case, the channel 22 is then formed in the upper region between the two vertical cross-sectional components. In order not to have to perforate the vertical inner edge of the channel 22 for the purpose of stacking the crates 2, a standing edge 25 can be formed under the base 6 of the crate 2', with interruptions 27 at points where, according to FIG. 11, the wavy pattern of the base edge 8' crosses over the wavy pattern of the inner edge of the upper edge 10. This can also bring about an additional positive engagement between the crates 2 stacked on top of one another.

The channel 22, which extends right around the top opening 16 of the crate 2 in the T-shaped edge 10, serves essentially to pass on liquid which has been passed into said channel from another crate 2 stacked on top. The flow path 26 of such liquid can be seen schematically in FIGS. 8 to 10. FIG. 2 shows the through bores required for this flow path: in the (black) channel 22 behind the edge 10 of the crate 2, the corners of the substantially rectangular basic shape of the crate 2 are in each case provided with first through bores 28. These are situated on the outer side of the crate wall 4 which adjoins on the underside at this point (also visible in FIG. 3). The liquid flows through these first through bores 28 from the channel 22 and outside the crate wall 4—and in the process even drips off along at the downwardly directed region of the outer edge surface 20 so as to pass still further outward away from the wall, resulting in the pattern of the falling water 26 according to FIGS. 9 and 10. Furthermore, according to FIG. 2, the crate 2 is provided in its base 6 with a total of four second through bores 30, of which two are situated in two of the four corners of the substantially rectangular basic shape of the crate 2. The base of the crate 6 is inclined toward the second through bores 30 by means of corresponding slopes such that liquid can flow reliably from the interior of the crate 2 through at least one of the second bores 30. The second bores 30 are made in the edge region of the base 6 at points where said base overlaps the upper edge 10, and hence also the channel 22, of a second, identical crate 2 when stacked thereon while rotated through 180°. Therefore, the second through bores 30 pass liquid away from the interior of a crate 2 into the channel 22 of a crate 2 stacked underneath and, from there, further to the outside through the two first bores 28.

As an alternative to the relatively small number of individual bores 28 according to FIG. 2, a series of holes (not shown) which extends, for example, along the entire channel 22 is also possible according to the invention. The series of holes can, for example, take the form of bores or slots which are only separated from one another by means of webs in order at all to in fact provide a material bridge between the outer edge region 20, 22, 24 of the crate 2 and the crate wall 4. Such a row of holes would extend, for example, directly outside the crate wall 4 and would cause liquid to run from the channel 22 as a liquid film along the outside of the wall 4. The evaporation thereof promoted over the large area of the crate wall 4 would additionally cool the crate 2. In order additionally to pass as far as possible all the liquid or such a liquid film into the channel 22 of a crate 4 stacked underneath, according to the invention, for example, the lower one of the reliefs 14 extending around the crate 2 could be channel-shaped, or at least be designed, not as an overhang as shown, but as a projection—in each case with the lowest points constituting outflow points (possibly again with bores or slots) at points where, according to FIG. 11, the crate wall outwardly protrudes (12) beyond the channel 22 of the crate stacked underneath. However, even in the overhang form shown, it is possible for the reliefs 14, as a result of surface tension and adhesion of liquid, and in particular of water, at surfaces of solid bodies, to perform a conducting function for the liquid film toward in each case the locally deepest point of the relief—here too, the wavy-shaped pattern (14) thus once more provides a technical function.

With reference to FIGS. 2, 12 and 13, it can be seen that in addition the wavy outer contour 20 of the crate 2 as seen in plan view (FIGS. 2 and 12) has this form not just for esthetic reasons. Rather, the outer contour 20 is designed to be wavy in such a way that the wave shape of a lateral edge of the crate 2 is complementary to the wave shape of the opposite lateral edge, with the result that identical crates 2 adjacent to one another hug one another positively and tightly with these wave contours 20 (FIG. 12). FIG. 12 makes it clear that what is meant by "positively" for the purposes of the present invention is a certain degree of inter-engagement between two crates situated adjacent to one another in this way. This makes it significantly more difficult—as compared with conventional crates having straight instead of wavy edge contours 20—for the crates to shear off unfavorably from one another in the packing assembly, for example on a pallet 32 according to FIG. 13. Furthermore, this positive engagement according to the invention makes it easier to pre-position the crates 2, for example on a pallet 32, to form a uniform assembly. It can clearly be seen that, to ensure secure transportation, the pallet 32 and the crates stacked thereon still have to be fastened together by suitably applying straps (not shown) or a film wrap (not shown). However, it is also conceivable according to the invention for the lateral profile 20 according to FIG. 2 to be supplemented by more complex additional contours (not shown)—for example a dovetail profile—such that crates positioned next to one another are joined together at these contours so as to be positively connected not only to prevent shearing off from one another but also in other directions of action.

FIGS. 12 and 13 also clearly show that the crate system according to the invention also makes provision for different crate sizes. The crate 2 of certain size and having a substantially rectangular shape (in spite of the wavy outer contour 20) which has only been discussed so far is supplemented in the system depicted by a crate 34 of half the size according to FIGS. 12 and 13. Compared with the crate 2, this has approximately half the horizontal area and can be positively joined together, along its outer contours 20, which like those of the crate 2 are designed to have a complementary wave shape at mutually opposite lateral edges of the crate 34, to form an overall outer contour which corresponds to the outer contour 20 of the crate 2. This can be seen in FIG. 12, where two crates 34 occupy the area which would be occupied by a fourth crate 2 in the section of crates at the bottom left. The crate 34 is also a rotatable stacking crate having correspondingly wave-shaped side walls. The outflow system of the crate 34 also operates in the manner corresponding to that described previously with regard to the crates 2.

The invention claimed is:

1. A stackable crate comprising crate walls, a top opening and a base region, wherein:

the top opening has an edge region;

the edge region extends along the entire top opening, is channel-shaped in certain areas and comprises at least one first through bore formed as an outflow opening through the edge region and opening outside the crate wall;

the base region comprises at least one second through bore; and the edge and base regions are structurally configured in such a way that the base region of a first stackable crate, when placed on the edge region of an identical second stackable crate, is positively held laterally in a first stacked position which is designed to permit the flow of liquid through the at least one second through bore of the first stackable crate into the edge region of the second stackable crate and then through the at least one first through bore of the second stackable crate and along the outer side of the crate wall; and the first and second stackable crates are structurally configured to be inserted into and stacked inside one another in a second stacked position of 180° relative rotation as between the stackable crates about a vertical axis, wherein the edge region comprises lateral outer edges and surfaces with outer contours which are designed in a wavy-shaped pattern to form a complementary and form-fitting lock against shearing-off when placed laterally against the lateral outer edges and surfaces of one or more adjacent stackable crates, and further wherein the edge region has a vertical section that is H-shaped or in the shape of a T lying horizontally.

2. The stackable crate as claimed in claim 1, wherein the stackable crate has a substantially rectangular shape and the edge region has four corners which are channel-shaped.

3. The stackable crate as claimed in claim 1, wherein the edge region is channel-shaped all the way around the top opening.

4. The stackable crate as claimed in claim 1, wherein the channel-shaped areas of the edge region slope in the direction of the first through bore when the stackable crate is positioned horizontally.

5. The stackable crate as claimed in claim 2, wherein the base has four corners and a second through bore is arranged in each of the four corners of the base.

6. The stackable crate as claimed in claim 1, wherein the crate wall is wavy.

7. The stackable crate as claimed in claim 1, wherein a vertical section of the crate wall is in the shape of a stepped relief.

8. The stackable crate as claimed in claim 7, wherein the stepped relief extends in a wavy shape around the stackable crate.

9. The stackable crate as claimed in claim 1, further comprising a handle-forming edge extending around the top opening of the crate, wherein the uppermost edge of the lateral edge surface of the handle-forming edge is wavy.

10. The stackable crate as claimed in claim 1, wherein the stackable crate is injection molded from polyethylene, polypropylene or combinations thereof.

* * * * *